US012540364B2

(12) United States Patent
Tang

(10) Patent No.: US 12,540,364 B2
(45) Date of Patent: Feb. 3, 2026

(54) TOUGH AND CORROSION RESISTANT WHITE CAST IRONS

(71) Applicant: Weir Minerals Australia Limited, Artarmon (AU)

(72) Inventor: Xinhu Tang, Artarmon (AU)

(73) Assignee: Weir Minerals Australia Limited (AU)

( * ) Notice: Subject to any disclaimer, the term of this patent is extended or adjusted under 35 U.S.C. 154(b) by 600 days.

(21) Appl. No.: 16/770,018

(22) PCT Filed: Dec. 4, 2018

(86) PCT No.: PCT/AU2018/051297
§ 371 (c)(1),
(2) Date: Jun. 4, 2020

(87) PCT Pub. No.: WO2019/109138
PCT Pub. Date: Jun. 13, 2019

(65) Prior Publication Data

US 2021/0238702 A1 Aug. 5, 2021

(30) Foreign Application Priority Data

Dec. 4, 2017 (AU) ..... 2017904866

(51) Int. Cl.
*C21D 6/00* (2006.01)
*C21D 5/04* (2006.01)
(Continued)

(52) U.S. Cl.
CPC ..... *C21D 6/002* (2013.01); *C21D 5/04* (2013.01); *C22C 33/08* (2013.01); *C22C 37/06* (2013.01); *C21D 2211/004* (2013.01)

(58) Field of Classification Search
USPC ..... 148/543
See application file for complete search history.

(56) References Cited

U.S. PATENT DOCUMENTS 4,844,738 A 7/1989 Tanase et al.
5,803,152 A * 9/1998 Dolman ..... B22D 27/04 148/668
(Continued)

FOREIGN PATENT DOCUMENTS

CA 984185 A 2/1976
CN 101195890 A 6/2008
(Continued)

OTHER PUBLICATIONS

Tang et al. "Beneficial Effects of the Core-Shell Structure of Primary Carbides in High-Cr (45 wt%) White Cast Irons on Their Mechanical Behavior and Wear Resistance." Tribol Lett (2015) 58:44. pp. 1-10. Available online Apr. 24, 2015. (Year: 2015).*
(Continued)

*Primary Examiner* — Brian D Walck
(74) *Attorney, Agent, or Firm* — Morriss O'Bryant Compagni Cannon, PLLC

(57) ABSTRACT

An end-use casting of a high chromium white iron, i.e. a casting that has been heat-treated, includes a ferrous matrix and at least two different chromium carbides dispersed in the matrix, with at least one of the chromium carbides including a transformation product of an as-cast chromium carbide.

10 Claims, 4 Drawing Sheets

(51) Int. Cl.
*C22C 33/08* (2006.01)
*C22C 37/06* (2006.01)

(56) References Cited

U.S. PATENT DOCUMENTS

| | | | |
|---|---|---|---|
| 6,165,288 | A | 12/2000 | Dewars et al. |
| 2015/0284829 | A1 | 10/2015 | Cheney |

FOREIGN PATENT DOCUMENTS

| | | | |
|---|---|---|---|
| CN | 102851569 | A | 1/2013 |
| CN | 107130166 | A | 9/2017 |
| DE | 10064056 | A1 | 11/2001 |
| EP | 0029539 | A1 | 6/1981 |
| EP | 0371760 | B1 | 6/1990 |
| EP | 1472382 | A0 | 11/2004 |
| EP | 1825013 | A0 | 8/2007 |
| EP | 2351865 | A1 | 8/2011 |
| EP | 2351866 | A1 | 8/2011 |
| GB | 2153846 | A | 8/1985 |
| JP | H01162745 | A | 6/1989 |
| JP | 2000328199 | A | 11/2000 |
| WO | 1984004760 | A1 | 7/1989 |
| WO | 2004104253 | A1 | 12/2004 |
| WO | 2011091479 | A1 | 8/2011 |

OTHER PUBLICATIONS

Tang et al. "Microstructure of high (45 wt.%) chromium cast irons and their resistances to wear and corrosion." Wear 271 (2011). pp. 1426-1431. (Year: 2011).*

English language machine translation of CN 107130166. Generated Nov. 3, 2023. (Year: 2023).*

English language machine translation of CN 102851569. Generated Nov. 3, 2023. (Year: 2023).*

Pearce, et al.,: "Duplex nature of eutectic carbides in heat treated 30% chromium cast iron," Jr. of Materials Science Letters; Jan. 1, 1986, pp. 1063-1064.

Wang, J., et al.: "Influence of secondary carbides precipitation and transformation on hardening behavior of a 15 Cr-1 Mo-1.5 V white iron"; Materials Characterization, Elsevier, New York, NY; vol. 55, No. 3; (Sep. 1, 2005); pp. 234-240.

Studnicki, A, et al.; "Wear resistance of chromium cast iron—research and application"; Jr. of Achievements in Materials and Manufacturing Engineering, vol. 16, Issue 1-2; May-Jun. 2006; pp. 63-73.

Karantzalis, E., et al.: "Microstructure and properties of high chromium cast irons: effect of heat treatments and alloying additions"; International Jr. of Cast Metals Research; vol. 22, No. 6, Dec. 2009; pp. 448-456.

Ortega-Cubillos, P, et al.: "Wear resistance of high chromium white cast iron for coal grinding rolls"; Revista Facultad De Ingenieria Universidad De Antioquia, No. 76 (2015); pp. 134-142.

(Anonymous); "High Chromium Cast Iron: Part Two"; Total Materia Article; Sep. 2017; pp. 1-2.

Karantzalis, E., et al., "Microstructure and properties of high chromium cast irons: Effect of heat treatments and alloying additions," International Journal of Cast Metal Research, 2009, vol. 22, No. 6, pp. 448-456.

Pearce, J.T.H, et al., "Duplex nature of eutectic carbides in heat treated 30% chromium cast iron," Journal of Materials Science Letters, 1986, vol. 5, pp. 1063-1064.

Wang, J, et al., "Influence of secondary carbides precipitation and transformation on hardening behaviour of a 15 Cr-1 Mo-1.5V white iron," Materials Characterization, 2005, vol. 55, pp. 234-240.

Cui, J, et al., "Understanding effects of Cr content on the slurry erosion behavior of high-Cr cast irons through local property mapping and computational analysis": WEAR (Elsevier), 376-377 (2017); pp. 587-594.

A. Wiengmoon, et al., "A microstructural study of destabilised 30 wt%Cr-2.3 wt%C high chromium cast iron," ISIJ International, vol. 44, No. 2; pp. 396-403 (2004).

Kun Wang, et al., "Formation of core (M7C3)-shell (M23C6) structured carbides in white cast irons: A thermo-kinetic analysis," Computational Materials Science, vol. 154; pp. 111-121 (Jun. 27, 2018).

* cited by examiner

TOUGH AND CORROSION RESISTANT WHITE CAST IRONS

TECHNICAL FIELD

The present invention relates to tough and corrosion resistant high chromium white irons (also referred to herein as high chromium white cast irons) comprising hard material particles dispersed in a host metal (which term includes metal alloy).

The present invention also relates to equipment used in the mining and mineral processing industries, such as pump components (including components for slurry pumps), that include castings or facings of high chromium white irons where the equipment is exposed to any one or more than one of severe abrasion, impact, erosion and corrosion wear.

The present invention also relates to a method of forming high chromium white irons.

The present invention also relates to a method of forming castings or facings of high chromium white irons as at least a part of equipment used in the mining and mineral processing industries.

BACKGROUND

Equipment used in the mining and mineral processing industries often is subject to any one or more than one of severe abrasion, impact, erosion and corrosion wear.

The equipment includes, for example, slurry pumps and pipelines, mill liners, crushers, transfer chutes and ground-engaging tools.

By way of particular example, metal "wet-end" components in slurry pumps are subject to abrasion, impact, erosion and corrosion wear in service due to the passage of high tonnages of hard, sharp mineral particles through the pumps. The pump components include frame plate liners, impellers, volutes and throat bushes. Typically, the components range in size from 2 kilograms up to approximately 20 or more tonnes in mass. The components include castings of wear resistant materials or facings of wear resistant materials where the equipment is subject to any one or more than one of severe abrasion, impact, erosion and corrosion wear and require replacement at periodic intervals to maintain pump performance in service.

Material loss in the slurry pump metal wet-end components in service can be attributed to one or more of the following mechanisms:

- Erosive wear by mineral particles (nominally 0.1-100 mm in diameter) flowing through the equipment.
- Corrosion as a consequence of contact with liquids (which term includes slurries) flowing through the pumps, where the pH of the liquids can vary from very acidic to very basic.
- Spalling or cracking due to impact loading in service.

A family of high chromium white irons known as high chromium white cast irons (HCWCIs) described in International Standards Association ISO 21988, Sections 1 c) and 3.3 provides a range of alloys that optimise the three major properties of (a) wear resistance, (b) corrosion resistance and (c) fracture toughness that are required for slurry pump wet-end components in a wide range of operating conditions.

The first HCWCI was developed 100 years ago and patented in 1917 (U.S. Pat. No. 1,245,552).

The nominal bulk chemistry of the first HCWCI alloy, as defined in claim 1 of the US patent, is:

Chromium: 20-35 wt. %.

Carbon: 1.5-3.0 wt. %.

Silicon: 0.0-3.0 wt. %.

Iron: balance.

The first HCWCI alloy, designated as "Cr27" in Table 3 of International Standards Association ISO 21988 and referred to hereinafter as "Cr27", complies with the U.S. Pat. No. 1,245,552 claims and is essentially the "workhorse" material used today in many slurry pump applications that are subject to abrasion, erosion and corrosion wear.

The ISO composition of Cr27 is as follows, in wt. %:

| C | Si max. | Mn | P max. | S max. | Cr | Ni max. | Mo max. | Cu max. |
|---|---|---|---|---|---|---|---|---|
| 1.8-3.6 | 1.0 | 0.5-2.0 | 0.08 | 0.08 | 23-30 | 2.0 | 3.0 | 1.2 |

The microstructure of castings of Cr27 consists of two distinct phases, namely:

25 volume % of chromium carbides.

75 volume % ferrous matrix.

There have been further developments in the field of high chromium white cast irons since the above-described first HCWCI was developed about 100 years ago. These developments have resulted in improvements in performance in a number of areas.

By way of example, a family of HCWCI, designated Cr35, was developed by the applicant to produce slurry pump parts to satisfy a number of high wear applications.

Cr35 was adopted by the Australian Standards Association and the International Standards Association as a designated wear resistant material and was incorporated in AS/NZS 2027 and ISO 21988, respectively, about 10 years ago.

The ISO composition of Cr35 is as follows, in wt. %:

| C | Si max. | Mn | P max. | S max. | Cr | Ni max. | Mo max. | Cu max. |
|---|---|---|---|---|---|---|---|---|
| 3.0-5.5 | 1.0 | 1.0-3.0 | 0.06 | 0.06 | 30-40 | 1.0 | 1.5 | 1.2 |

The wear resistance of the Cr35 family is recognised as superior to that of Cr27 alloy in many slurry pump applications where erosive wear is the dominant mode of material loss.

The applicant has realised that there is still a need for further improvements in some applications, including slurry pump applications (and for other equipment in a range of other applications), especially where impact wear is significant.

The above description should not be taken to be an admission of the common general knowledge in Australia or elsewhere.

SUMMARY OF THE DISCLOSURE

The applicant has identified a combination of composition and microstructure of castings of high chromium white irons that exhibit toughness and corrosion resistance that are very useful in a number of end-use applications of the castings.

The combination identified by the applicant is high chromium white irons that have compositions that are characterised by (a) ranges (which can be described as "regions" when the Cr concentration range is plotted against the C concentration range—such as shown in FIG. 1) of Cr and C and (b) Cr:C ratios within these ranges that are cast and then heat-treated so that at least part of the chromium carbides in as-cast forms of the castings transform to another chromium carbide, whereby the end-use forms of the castings have mixtures of chromium carbides with at least one of the chromium carbides being a transformation product of an as-cast chromium carbide.

The term "transformation product" is understood herein to mean a product that forms as a result of heat treatment and has a different phase to the original un-heat-treated phase of the product.

The microstructures of these end-use forms of the castings are quite different to the microstructures of other end-use forms of castings of HCWCIs such as Cr27 and Cr35.

The microstructure of the invention is defined in this specification in two states. One state is the microstructure in the as-cast form of the casting. The other state is the microstructure in the end-use form of the casting.

Typically, the end-use form of a casting is a heat-treated as-cast casting.

Typically, the heat treatment increases the amount of chromium carbides and decreases the amount of elemental chromium in solution in the matrix of the casting.

In general terms, the invention provides a casting of a high chromium white iron that, in an end-use form of the casting after heat treatment, includes a ferrous matrix and at least two different chromium carbides dispersed in the matrix, with at least one of the chromium carbides including a transformation product of an as-cast chromium carbide.

In any given situation, the amount of the transformation product may be selected based on a range of factors, including but not limited to the requirements for the end-use form of the casting and the composition of the casting.

The transformation product may be at least 5%, typically at least 10%, typically less than 60% of the as-cast chromium carbides.

Typically, the high chromium white iron consists of two different chromium carbides dispersed in the matrix of the end-use form of the casting, i.e. after heat treatment.

In one embodiment, the chromium carbides dispersed in the matrix of the end-use form of the casting, i.e. after heat treatment, are $M_7C_3$ and $M_{23}C_6$, where "M" comprises Cr, Fe, and Mn.

In this embodiment, at least a part of the $M_{23}C_6$ is a transformation product of $M_7C_3$ with the $M_{23}C_6$ forming during heat treatment of the as-cast form of the casting. It is noted that there may be some $M_{23}C_6$ in an as-cast form of the casting and, therefore, in this situation the heat treatment increases the amount of $M_{23}C_6$ as a consequence of transforming some of the $M_7C_3$.

The chromium carbides in the heat-treated end-use form of the casting may include particles that have a hard core of $M_7C_3$ surrounded by a softer shell of $M_{23}C_6$ which acts as a transition zone between the softer metal matrix and the extremely hard $M_7C_3$ carbide core.

The composition of the casting may comprise the following composition ranges, described herein as Region I and with the Cr and C concentration ranges shown in FIG. 1 as Region I:

Cr: 30-40 wt. %
C: 1.5-3 wt. %
Cr/C ratio (wt. %): 9:1-15:1.
Up to 3 wt. % each of any one or more than one of Mn, Si, Ni, Mo, and Cu,
Incidental impurities
Balance: Fe The composition ranges described in the preceding paragraph, including the Cr/C ratio, are based on direct experimental work and casting and metallurgy experience of the applicant and computer modelling work carried out by the applicant.

The impurities may include sulphur, phosphorus, and aluminum.

The chromium carbides dispersed in the matrix may be 30-60 vol. % of the casting.

The chromium carbides dispersed in the matrix may be 40-50 vol. % of the casting.

The $M_7C_3$ chromium carbides may be 10-20 vol. % of the casting.

The $M_7C_3$ chromium carbides may be 15-20 vol. % of the casting.

The $M_{23}C_6$ chromium carbides may be 20-35 vol. % of the casting.

The $M_{23}C_6$ chromium carbides may be 25-30 vol. % of the casting.

The matrix may be 40-70 vol. % of the casting.

The Cr/C ratio (wt. %) may be 10:1-15:1.

The Cr/C ratio (wt. %) may be 10:1-14:1.

In this embodiment, a proportion of the chromium carbides are in the form of primary $M_7C_3$ due to the relative chromium and carbon contents of the alloys. The presence of primary carbides in high chromium white irons is associated with improved wear resistance but poor impact toughness. The invention seeks to overcome this limitation due to the binary nature of the primary carbides. Typically, at least some of the particles of chromium carbides have a hard core of $M_7C_3$ that is surrounded by a softer shell of $M_{23}C_6$ which acts as a transition zone between the much softer metal matrix and the extremely hard $M_7C_3$ carbide core, allowing dissipation of impact energy leading to a reduced propensity for the primary carbides to crack during large particle impingement and impact. Furthermore, the comparatively elevated chromium in these compositions leads to a desirable increase in the corrosion resistance of a casting. This combination of high carbide volume fraction, impact resistant primary carbides and increased corrosion resistance makes this alloy particularly suitable for slurry pumping duties in minerals processing circuits, oil sands hydrotransport, and coarse mine tailings duties.

In another embodiment, the chromium carbides dispersed in the matrix of the end-use form of the casting, i.e. after heat treatment, are $M_7C_3$ and $M_3C$, where "M" comprises Cr, Fe, and Mn.

The chromium carbides in the heat-treated end-use form of the casting may include particles that have a hard core of $M_7C_3$ surrounded by a softer shell of $M_3C$ which acts as a transition zone between the softer metal matrix and the extremely hard $M_7C_3$ carbide core.

In this embodiment the at least a part of the $M_3C$ is a transformation product of $M_7C_3$ with the $M_3C$ forming during heat treatment of the as-cast form of the casting. It is noted that there may be some $M_3C$ in an as-cast form of the casting and, therefore, in this situation the heat treatment increases the amount of MC as a consequence of transforming some of the $M_7C_3$.

The composition of the casting may comprise the following composition ranges, described herein as Region II and with the Cr and C concentration ranges shown in FIG. 1 as Region II:

Cr: 10-23 wt. %
C: 3.3-5.5 wt. %
Cr/C ratios (wt. %): 2:1-4:1.
Up to 3 wt. % each of any one or more than one of Mn, Si, Ni, Mo, and Cu
Incidental impurities Balance: Fe The composition ranges described in the preceding paragraph, including the Cr/C ratio, are based on direct experimental work and casting and metallurgy experience of the applicant and computer modelling work carried out by the applicant.

The chromium carbides dispersed in the matrix may be 30-70 vol. % of the casting.

The chromium carbides dispersed in the matrix may be 30-60 vol. % of the casting.

The matrix may be 30-70 vol. % of the casting.

The Cr/C ratio (wt. %) may be 2.5:1-3.5:1.

In this embodiment, at least some of the particles of chromium carbides have a hard core of $M_7C_3$ that is surrounded by a softer shell of $M_3C$ which acts as a transition zone between the much softer metal matrix and the extremely hard $M_7C_3$ carbide core, allowing dissipation of impact energy leading to a reduced propensity for the primary carbides to crack during large particle impingement and impact.

The invention also provides a casting of a high chromium white cast iron that, in the as-cast form of the casting, includes a ferrous matrix with chromium in solution in the matrix and chromium carbides dispersed in the matrix, with the casting characterised by:

Cr: 30-40 wt. %

C: 1.5-3 wt. %

Cr/C ratios (wt. %): 9:1-15:1

Total carbides in the casting: 30-60 vol. %

Up to 3 wt. % each of any one or more than one of Mn, Si, Ni, Mo, and Cu

Incidental impurities

Balance: Fe.

The invention also provides a casting of a high chromium white cast iron that, in the as-cast form of the casting, includes a ferrous matrix with chromium in solution in the matrix and chromium carbides dispersed in the matrix, with the casting characterised by:

Cr: 10-23 wt. %

C: 3.3-5.5 wt. %

Cr/C ratios (wt. %): 2:1-4:1

Total carbides in the casting: 30-70 vol. %

Up to 3 wt. % each of any one or more than one of Mn, Si, Ni, Mo, and Cu,

Incidental impurities

Balance: Fe

The purpose of Mn, Si, Ni, Mo, and Cu, when part of the composition, is to contribute to forming required martensitic, austenitic, ferritic, or mixed ferrous matrices.

The microstructure of the as-cast form of the casting typically includes a ferrous matrix with chromium in solution in the matrix, eutectic chromium carbides dispersed in the matrix, primary chromium carbides dispersed in the matrix, and optionally secondary carbides dispersed in the matrix.

Typically, the eutectic carbides, the primary carbides, and the secondary carbides in the as-cast casting are $M_7C_3$ carbides where "M" comprises Cr, Fe, and Mn.

The term "primary carbides" is understood to mean carbides that precipitate from a melt between the liquidus and solidus temperatures.

The term "eutectic carbides" is understood to mean carbides that precipitate from a melt at the solidus temperature.

The term "secondary carbides" is understood to mean carbides that form via solid-state reactions in castings.

The reference to "as-cast form of the casting" in the preceding paragraph (and as used in the earlier part of the specification) is understood to mean the casting at the point the casting is formed and cooled continuously in a mould to ambient temperature. The cooling time could be minutes for smaller castings and several weeks for larger castings. Typically, the castings could be 1 or 2 kilograms and up to approximately 20 tonnes in mass.

The term "as-cast form of the casting" does not extend to castings that have been subjected to after-casting heat treatments, for example that result in precipitation of secondary chromium carbides from solution in the matrix and therefore changes the concentration of elements in solution in the matrix.

The ferrous matrix of the as-cast casting may be any suitable matrix.

By way of example, the ferrous matrix may be substantially austenite.

The ferrous matrix of the end-use casting, i.e. after heat treatment of the as-cast form of the casting, may be any suitable matrix. By way of example, the ferrous matrix may be substantially martensite.

The casting may be at least 100 kg.

The casting may be at least 200 kg.

The casting may be at least 400 kg.

The casting may be at least 1 tonne.

The casting may be at least 2 tonnes.

The casting may be at least 3 tonnes.

The fracture toughness of the casting may be selected as required having regard to the end-use application of the casting.

The corrosion resistance of the casting may be selected as required having regard to the applications for the end-use form of the casting. Corrosion resistance is not a material property and, as is the case with wear resistance, depends on a number of operating factors.

The wear resistance of the casting may be selected as required having regard to the end-use application of the casting. Wear resistance is not a material property. Wear resistance is a system property and depends on a number of operating factors, e.g. in the case of pumps conveying slurries, the hardness of slurry particles, the size and angularity of slurry particles, slurry velocity, and slurry pH, etc.

The invention also comprises equipment used in the mining and mineral processing industries, such as pump components, that includes the above-described end-use form of the casting where the equipment is exposed to any one or more than one of severe abrasion, erosion and corrosion wear.

As noted above, equipment of particular interest to the applicant is "wet-end" components in mill circuit slurry pumps.

The equipment may also include, for example, pipelines, mill liners, crushers, transfer chutes and ground-engaging tools.

The invention also provides a method of producing the above-described as-cast form of the casting that includes the steps of:

(a) forming a melt of a high chromium white cast iron, such as the above-described high chromium white cast irons;

(b) pouring the melt into a mould and forming a casting of the high chromium white cast iron having a microstructure that includes a ferrous matrix that contains chromium in solution, eutectic chromium carbides dispersed in the matrix, and primary chromium carbides dispersed in the matrix, and optionally secondary carbides dispersed in the matrix.

The invention also provides a method of producing the above-described end-use form of the casting that includes a heat treatment step of heating the as-cast form of the casting and transforming at least part of the as-cast chromium carbides to a mixture of chromium carbides.

The transformation product may be at least 5%, typically at least 10%, typically less than 60% of the as-cast chromium carbides.

The heat treatment step may include heating the as-cast form of the casting to 800-1000° C., typically 850-950° C. and holding the casting at temperature for up to 1 day and air cooling the casting to ambient temperature.

The treatment step may further include tempering the heat-treated casting at 200-400° C., typically 250-350° C., for up to 12 hours to further improve toughness and/or stress relief.

Where the as-cast form of the casting includes $M_7C_3$ and $M_{23}C_6$, the heat treatment step may be selected to transform at least part of the $M_7C_3$ and forming $M_{23}C_6$ as a transformation product.

The chromium carbides in the heat-treated end-use form of the casting may include particles that have a hard core of $M_7C_3$ surrounded by a softer shell of $M_{23}C_6$ which acts as a transition zone between the softer metal matrix and the extremely hard $M_7C_3$ carbide core.

Where the as-cast form of the casting includes $M_7C_3$ and $M_3C$, the heat treatment step may be selected to transform at least part of the $M_7C_3$ and forming $M_3C$ as a transformation product.

The chromium carbides in the heat-treated end-use form of the casting may include particles that have a hard core of $M_7C_3$ surrounded by a softer shell of $M_3C$ which acts as a transition zone between the softer metal matrix and the extremely hard $M_7C_3$ carbide core.

BRIEF DESCRIPTION OF THE DRAWINGS

Embodiments of the invention are now described, by way of example only, with reference to the following Figures, of which.

DETAILED DESCRIPTION OF EMBODIMENTS

As noted above, the applicant has identified a combination of composition and microstructure of castings of high chromium white irons that exhibit corrosion resistance and toughness that are very useful in a number of end-use applications of the castings.

The combination identified by the applicant is high chromium white irons that have compositions that are characterised by (a) ranges of Cr and C concentrations and (b) Cr:C ratios within these ranges that can be cast and then heat-treated so that at least part of the chromium carbides in as-cast forms of the castings transform to another chromium carbide, whereby the end-use forms of the castings have mixtures of chromium carbides with at least one of the chromium carbides including a transformation product of an as-cast chromium carbide.

The amount of the transformation product may be selected based on a range of factors, including the requirements for the end-use form of the casting and the composition of the casting.

The microstructures of the end-use forms of the castings are quite different to the microstructures of other end-use forms of castings of HCWCIs such as Cr27 and Cr35.

It is evident form the above that (a) selected Cr and C concentrations, (b) selected Cr:C ratios and (c) heat-treated microstructures of end-use castings of these Cr and C concentrations and Cr:C ratios are important to produce end-use castings of the invention.

Figure 1:
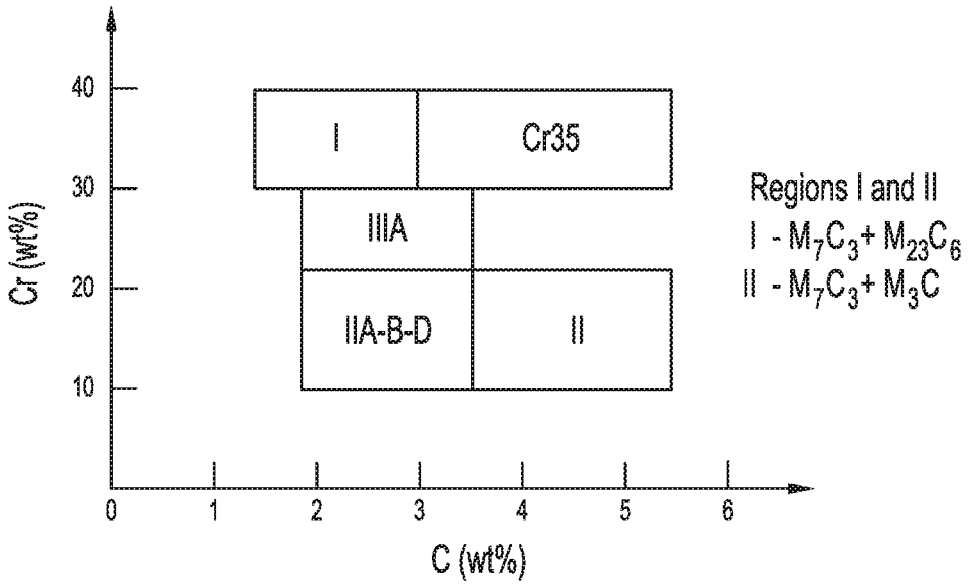
FIG. 1 is a Cr/C diagram that shows two embodiments of ranges (i.e. regions) of Cr and C concentrations in high chromium white cast irons in accordance with the invention.

FIG. 1 is a Cr/C diagram that shows two embodiments of Cr and C concentration ranges in high chromium white cast irons in accordance with the invention. The two embodiments are identified as Regions I and II in the Figure.

FIG. 1 also shows the Cr and C concentration regions of the known Cr27 and Cr35 high chromium white cast irons. The Cr27 regions are described as ASTM A532 IIIA and IIA, IIB and IID in the Figure.

With reference to FIG. 1, the composition ranges of Region I are:

Cr: 30-40 wt. %

C: 1.5-3 wt. %

As a result of direct experimental work and casting and metallurgy experience of the applicant and computer modelling work carried out by the applicant, the applicant has also identified that the Cr/C ratios (wt. %) in Region I should be in a range of 9:1-15:1, typically, 10:1-15:1. The applicant has also identified in this work that it is 30 preferable that the total carbides in an end-use form of the casting be 30-60 vol. %, and the composition have up to 3 wt. % each of any one or more than one of Mn, Si, Ni, Mo, and Cu, with incidental impurities, and the balance Fe.

With further reference to FIG. 1, the composition ranges of Region II are:

Cr: 10-23 wt. %

C: 3.3-5.5 wt. %

As a result of direct experimental work and casting and metallurgy experience of the applicant and computer modelling work carried out by the applicant, the applicant has also identified that the Cr/C ratios (wt. %) in Region II should be in a range of 2:1-4:1. The applicant has also identified in this work that it is preferable that the total carbides in an end-use form of the casting 30-70 vol. %, and the composition have up to 3 wt. % each of any one or more than one of Mn, Si, Ni, Mo, and Cu, incidental impurities, and balance Fe.

Figure 2A:
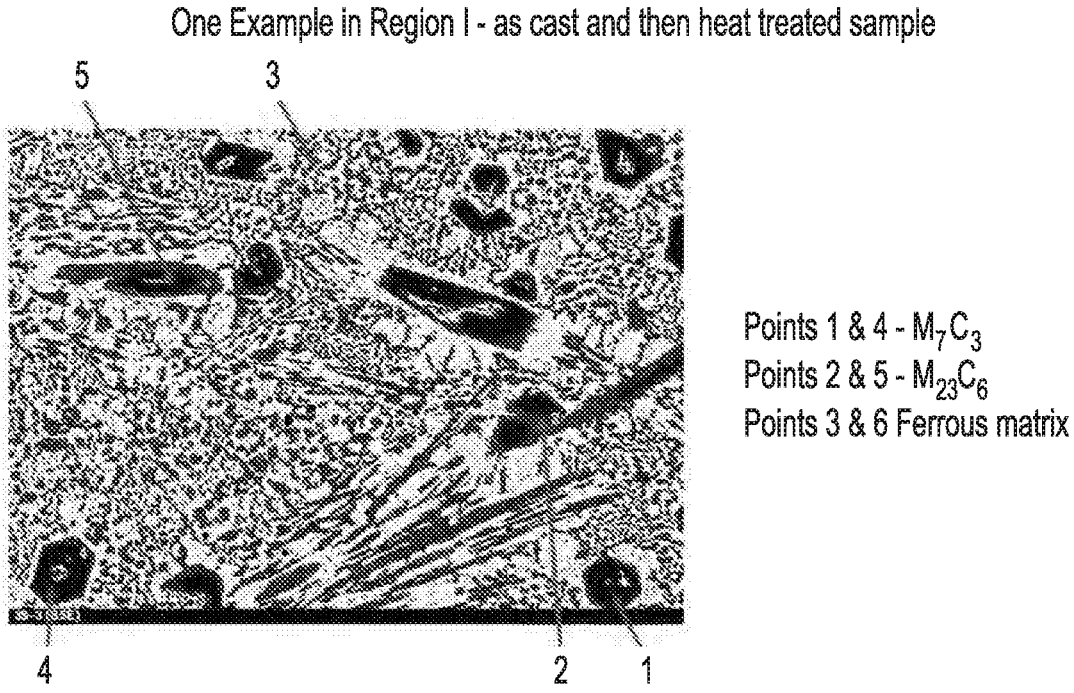
FIG. 2A is a representative SEM image of a sample end-use casting, i.e. as-cast and heat-treated casting, in accordance with an embodiment of the invention.

FIG. 2A is a representative SEM image of a sample end-use casting, i.e. an as-cast and heat-treated casting, in Region I of FIG. 1.

Figure 2B:
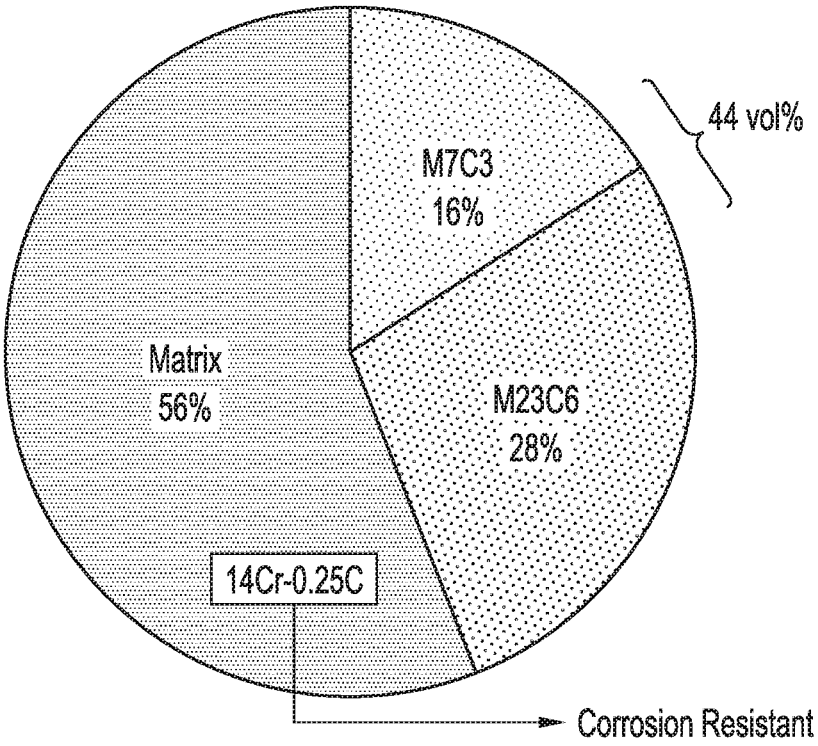
FIG. 2B is a pie chart of the constituents of the microstructure of the end-use casting shown in FIG. 2A.

FIG. 2B is a pie chart of the constituents of the microstructure of the casting shown in FIG. 2A.

The sample comprised 35 wt. % Cr.

With reference to FIG. 2A, the microstructure of the end-use casting comprises a ferrous matrix (shown by way of example as points 3 and 6 in FIG. 2A) and chromium carbides dispersed in the matrix. The chromium carbides comprise $M_7C_3$ carbides (see points 1 and 4 in FIG. 2A) and $M_{23}C_6$ carbides (see points 2 and 5 in FIG. 2A), where "M" comprises Cr, Fe, and Mn. At least a part of the $M_{23}C_6$ carbides form as a transformation product of $M_7C_3$ carbides in the as-cast form of the casting. At least some of the chromium carbides have a hard core of $M_7C_3$ that is surrounded by a softer shell of $M_{23}C_6$. This feature is discussed further below in relation to FIG. 6.

FIG. 2B shows that the matrix in the end-use casting in FIG. 2A is 56 vol. % and the chromium carbides in the end-use casting in FIG. 2A are 44 vol. % of the total volume of the end-use casting, with the matrix comprising 14 wt. % Cr and 0.25 wt. % C, and the chromium carbides comprising 16 vol. % $M_7C_3$ carbides and 28 vol. % $M_{23}C_6$ carbides of the total volume of the casting.

The as-cast form of the casting comprised an austenite matrix with $M_7C_3$ carbides dispersed in the matrix. Heat treatment of the as-cast form of the casting to produce the sample shown in FIG. 2A transformed the austenite matrix to martensite and transformed part of the $M_7C_3$ carbides to $M_{23}C_6$ carbides.

It can readily be appreciated that the relative proportions of the matrix and the chromium carbides in the casting, the Cr and C concentrations in the matrix, and the relative proportions of the $M_7C_3$ carbides and the $M_{23}C_6$ carbides in the chromium carbides may be varied as required having regard to the requirements of end-use applications of the castings. In this regard, as noted above, the important variables include the Cr and C concentrations within Region I, the selection of the Cr:C ratios within Region I to be within the range of 9:1-15:1, and the heat treatment conditions to achieve a required transformation of as-cast $M_7C_3$ carbides to $M_{23}C_6$ carbides.

Figure 6:
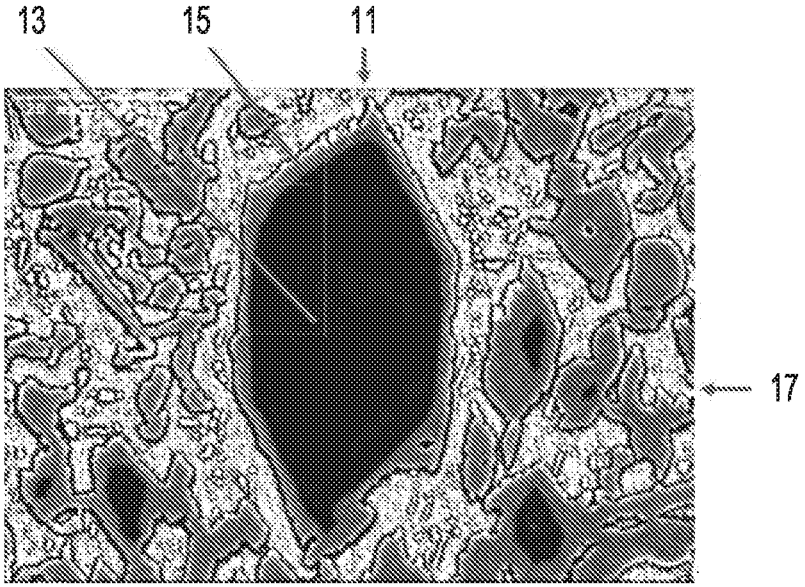
FIG. 6 is a representative SEM image of a sample end-use casting, i.e. as-cast and heat-treated casting, in accordance with an embodiment of the invention.

FIG. 6 is a representative SEM image of another sample end-use casting, i.e. as-cast and heat-treated casting, in Region I of FIG. 1.

The purpose of FIG. 6 is to provide more detail on the chromium carbides that have a hard core of $M_7C_3$ that is surrounded by a softer shell of $M_{23}C_6$ that is described above in relation to FIG. 2A. With reference to FIG. 6, a representative chromium carbide particle generally identified by the numeral 11 comprises a core 13 of $M_7C_3$ and an outer shell 15 of $M_{23}C_6$ in a matrix 17. The $M_{23}C_6$ in the particle forms as a transformation product of as-cast $M_7C_3$. The $M_{23}C_6$ acts as a transition zone between the much softer metal matrix 17 and the extremely hard $M_7C_3$ carbide core 15, allowing dissipation of impact energy leading to a reduced propensity for the primary carbides to crack during large particle impingement and impact.

Figure 3:
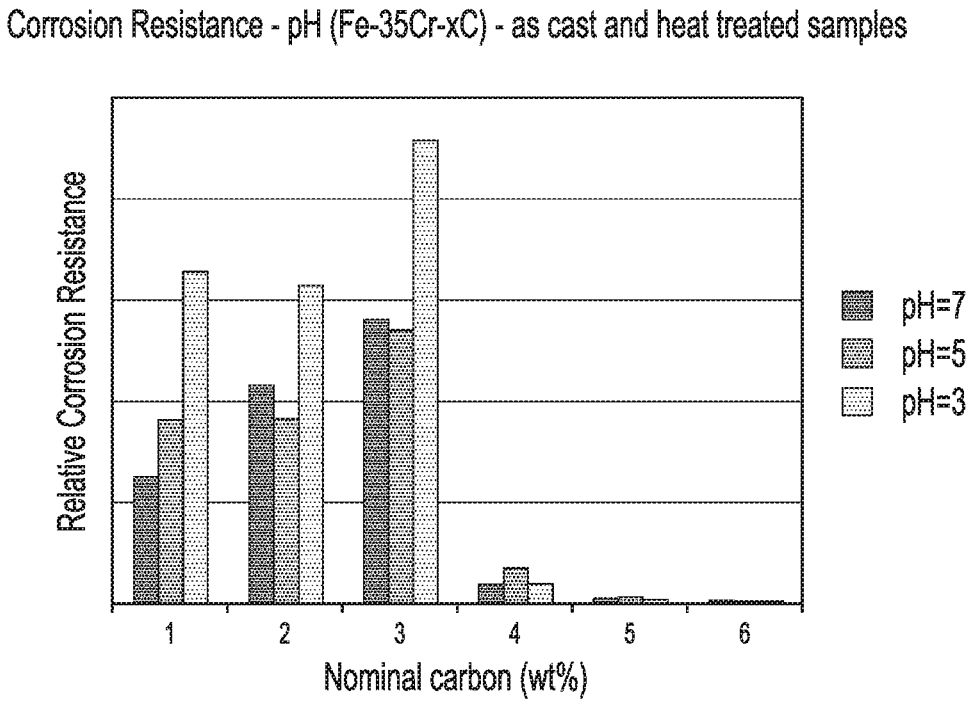
FIG. 3 is a graph of relative corrosion resistance versus C concentration of compositions of samples of end-use castings, i.e. as-cast and heat-treated casting, in accordance with an embodiment of the invention and samples of embodiments of end-use castings of known HCWCIs exposed to solutions having different pHs.

FIG. 3 is a graph of relative corrosion resistance versus C concentration of compositions of samples of end-use castings, i.e. as-cast and heat-treated castings, in accordance with the invention and samples of end-use castings of known HCWCIs exposed to solutions having different pHs.

FIG. 3 shows relative corrosion resistance results for (a) samples of end-use castings having a nominal C concentration of 3 wt. % in Region I of FIG. 1 in accordance with the invention and (b) samples of end-use castings of known HCWCIs have respective nominal C concentrations of 1 wt. %, 2 wt. %, 4 wt. %, 5 wt. % and 6 wt. %. The samples were exposed to solutions of pH3, pH5, and pH7.

It is clear from FIG. 3 that, in relative terms, the corrosion resistance of the sample in accordance with the invention performed considerably better than the samples of known HCWCIs.

Figure 4A:
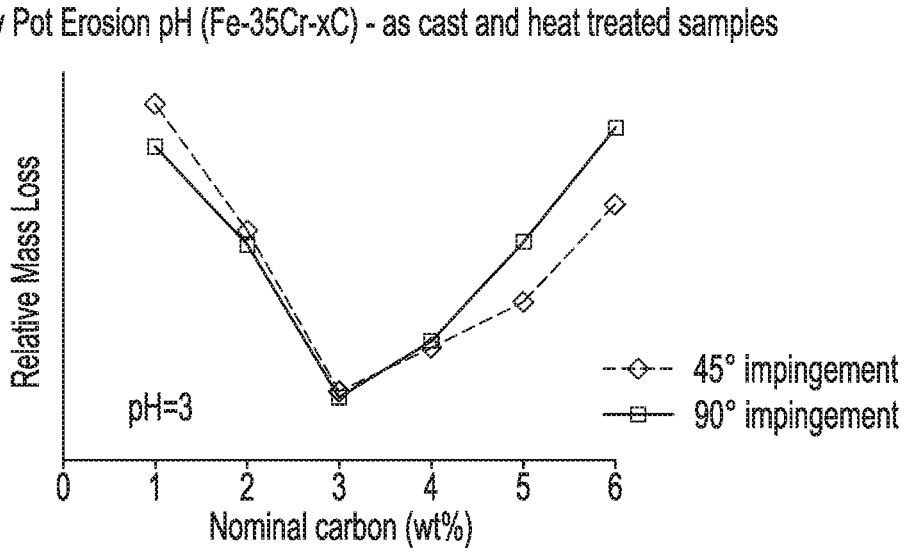
FIGS. 4A, 4B, and 4C are graphs of relative mass loss versus C concentration of compositions of samples of embodiments of end-use castings, i.e. as-cast and heat-treated casting, in accordance with the invention and samples of embodiments of end-use castings of known HCWCIs exposed to solutions having different pHs.
Figure 4B:
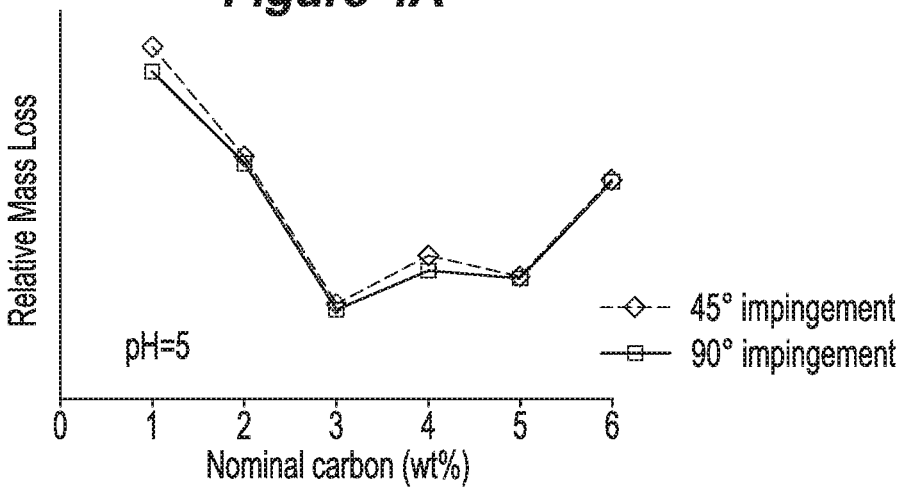
Figure 4C:
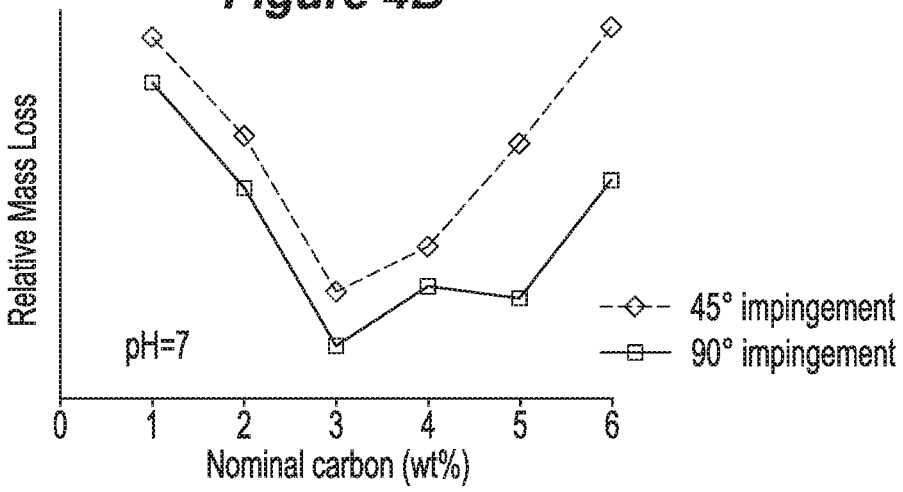

FIGS. 4A, 4B, and 4C are graphs of relative mass loss versus C concentration of compositions of samples of end-use castings, i.e. as-cast and heat-treated casting, in accordance with the invention and samples of end-use castings of known HCWCIs exposed to solutions having different pHs.

The experimental work reported in FIGS. 4A, 4B, and 4C was carried out in accordance with ASTM 1095. The experimental work assessed slurry pot erosion at impingement angles of 45° and 90°. FIGS. 4A, 4B, and 4C show the results for (a) samples of end-use castings having a nominal C concentration of 3 wt. % in Region I of FIG. 1 in accordance with the invention and (b) samples of end-use castings of known HCWCIs have respective nominal C concentrations of 1 wt. %, 2 wt. %, 4 wt. %, 5 wt. % and 6 wt. %. The samples were exposed to solutions of pH3, pH5, and pH7.

It is clear from FIGS. 4A, 4B, and 4C that, the erosion resistance of the sample in accordance with the invention performed considerably better than the samples of known HCWCIs.

Figure 5:
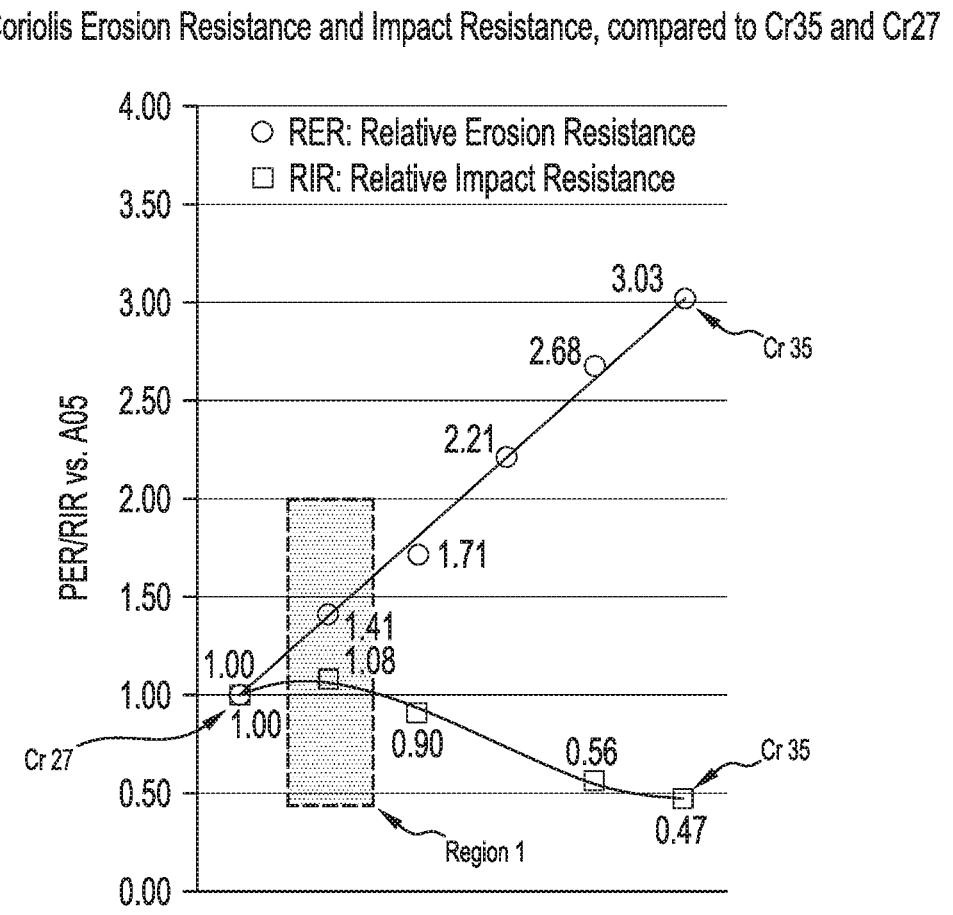
FIG. 5 is graph of relative erosion resistance and relative impact resistance of a sample embodiment of an end-use casting, i.e. as-cast and heat-treated casting, in accordance with the invention and end-use castings of Cr27 and Cr35 HCWCIs.

FIG. 5 is graph of relative erosion resistance and relative impact resistance of a sample end-use casting, i.e. as-cast and heat-treated casting, in accordance with the invention and end-use castings of Cr27 and Cr35 HCWCIs.

The relative erosion resistance tests were carried out in accordance with a standard Coriolis Scouring Erosion Testing procedure of the National Research Council of Canada. The relative impact resistance tests were carried out in accordance with a procedure and on a test rig developed by the applicant. In accordance with the procedure, impact particles were allowed to free-fall and hit a sample casting at a velocity of 9 m/s.

FIG. 5 shows that the erosion resistance of the sample end-use casting in accordance with the invention was better than that of the Cr27 sample.

FIG. 5 also shows that the impact resistance of the sample end-use casting in accordance with the invention was better than that of the Cr35 sample.

The applicant has found in a series of field trials that the combination of corrosion resistance, erosion resistance, and impact resistance, i.e. toughness, of the end-use casting in accordance with the invention is well-suited to a range of applications.

One field trial was carried out to evaluate the performance of castings of 150MCU impellers of pumps on SAG duty at a gold mining operation. The current 150MCU impellers are made from Cr35 HCWCI and these were found to shatter at about 2500 hours in service. The impellers all wore thin and shattered. In a field trial with an impeller comprising an end-use casting in accordance with the invention, the impeller remained intact for 3000 hours and was changed on the basis of a scheduled maintenance at this service life.

Many modifications may be made to the embodiments of the invention described in relation to the Figures without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A heat-treated casting of a high chromium white iron for improving toughness and corrosion resistance, includes a ferrous matrix and primary carbides including at least two different chromium carbides dispersed in the ferrous matrix, the primary carbides having a core including an as-cast chromium carbide and a shell surrounding the core including a transformation product of the as-cast chromium carbide wherein the as-cast chromium carbide is a $M_7C_3$ chromium carbide and the transformation product is a $M_{23}C_6$ chromium carbide, wherein the $M_{23}C_6$ carbide is formed during heat treatment of the casting, and wherein the composition of the casting comprises the following formula:

Cr: 30-40 wt. %

C: 1.5-3 wt. %

Cr/C ratios (wt. %): 9:1-15:1

Up to 3 wt. % each of any one or more than one of Mn, Si, Ni, Mo, or Cu,

Incidental impurities

Balance: Fe.

2. The heat-treated casting defined in claim 1 wherein "M" comprises Cr, Fe, and Mn.

3. The heat-treated casting defined in claim 1 wherein the chromium carbides dispersed in the ferrous matrix are 40-50 vol. % of the casting.

4. The heat-treated casting defined in claim 1 wherein the $M_{23}C_6$ chromium carbides are 25-30 vol. % of the casting.

5. The heat-treated casting defined in claim 1 wherein the matrix is 40-70 vol. % of the casting.

6. Equipment used in the mining and mineral processing industries that includes the heat-treated casting defined in claim 1.

7. The heat-treated casting defined in claim 1, wherein the $M_7C_3$ chromium carbides are 40-50 vol. % of the casting.

8. The heat-treated casting defined in claim 1, wherein the $M_7C_3$ chromium carbides are 10-20 vol. % of the casting.

9. The heat-treated casting defined in claim 1, wherein the $M_7C_3$ chromium carbides are 15-20 vol. % of the casting.

10. A heat-treated casting of a high chromium white iron for improving toughness and corrosion resistance, includes a ferrous matrix and primary carbides including at least two different chromium carbides dispersed in the matrix, the primary carbides having a core including an as-cast chromium carbide and a shell surrounding the core including a transformation product of the as-cast chromium carbide wherein the as-cast chromium carbide is a $M_7C_3$ chromium carbide and the transformation product is a $M_{23}C_6$ chromium carbide and wherein the composition of the casting is consisting of the following formula:

Cr: 30-40 wt. %

C: 1.5-<3 wt. %

Cr/C ratios (wt. %): 9:1-15:1

Up to 3 wt. % each of any one or more than one of Mn, Si, Ni, Mo, or Cu,

Incidental impurities

Balance: Fe; and wherein the transformation product is formed during heat treatment of the as-cast form of the casting when heated to between 800° and 1,000° C.

* * * * *